United States Patent [19]

Hehl

[11] 4,272,200

[45] Jun. 9, 1981

[54] HORN LOADED PIEZOELECTRIC MATRIX PRINTER DRIVE METHOD AND APPARATUS

[75] Inventor: Walter H. Hehl, Steinenbronn, Fed. Rep. of Germany

[73] Assignee: International Business Machines Corporation, Armonk, N.Y.

[21] Appl. No.: 957,260

[22] Filed: Nov. 2, 1978

[30] Foreign Application Priority Data

Dec. 16, 1977 [DE] Fed. Rep. of Germany ..... 2756134

[51] Int. Cl.[3] ..... B41J 3/10

[52] U.S. Cl. ..... 400/124; 310/323; 310/328; 400/126

[58] Field of Search ..... 400/124, 126; 310/323, 310/325, 328

[56] References Cited

U.S. PATENT DOCUMENTS

| | | | |
|---|---|---|---|
| 2,512,743 | 6/1950 | Hansell | 310/325 X |
| 3,970,184 | 7/1976 | Helmrich et al. | 310/328 X |
| 4,115,789 | 9/1978 | Fishbeck | 310/328 X |

*Primary Examiner*—Paul T. Sewell

*Attorney, Agent, or Firm*—Edward H. Duffield

[57] ABSTRACT

A method and apparatus for driving a matrix printer element is described which utilizes a piezoelectrically driven horn loaded driver. The horn is preferably tapered in the direction of the printing element and has a base area to which is attached a piezoelectric crystal excitation device. The piezoelectric crystal structure is driven by electric pulses which are coupled to the tapered horn to increase the impact velocity and stroke at the output end of the horn. The piezoelectric crystals may be controlled by the application of a particular pulse pattern to reduce resonance and insure an optimum deceleration of the crystal during rebound of the printing element.

3 Claims, 14 Drawing Figures

HORN LOADED PIEZOELECTRIC MATRIX PRINTER DRIVE METHOD AND APPARATUS

TECHNICAL FIELD

This invention relates to piezoelectric drive systems in general and to drive means and apparatus for matrix printer elements in particular.

PRIOR ART

From ultrasonic technology, the use of horns to increase motional and velocity amplitudes is known. (See W. P. Mason, "Physical Acoustics and the Properties of Solids", publishers Van Nostrand, Princeton, N.J. (1958), page 157 ff). For this purpose, a resonance-tuned horn is coupled to an acoustic source which may be a piezo crystal structure. When such a crystal is used as an acoustic source, it may be energized by means of an electric current applied in a stationary sinusoidal oscillation. When this occurs, the horn is operated in resonance and the optimum use of the energy is ensured. Such resonance-driven horns are used for ultrasonic drills, ultrasonic bonding, and other applications.

In conventional mechanical matrix printers, the kinetic and print energies are electromagnetically generated. In the case of large strokes of the print element, a repetition rate exceeding 2 kilohertz is not usually obtainable at a velocity which is sufficient to produce several copies. This is due to the fact that currents and current densities are allowed to assume limited values only. Generally, the time available for a print cycle is less than 400 microseconds (at typical travels of a matrix print element of 0.5 to 0.8 mm). Thus, velocities of 2 to 5 m/sec. are necessary for energizing the print element.

In the German Offenlegungsschrift No. 2524854 the use of piezo crystal structures for matrix printing is described in principle. However, the elongation velocity of the piezoelectric drive element is limited by the breaking point of the piezo ceramic material. Limit values for modern piezo ceramics can reach velocities of 0.2 to 0.4 m/sec. Even in the case of mechanical bias, these values cannot be increased further at adequate electric voltages. The piezo elongations obtainable are very small (5 to 10 μm at a crystal length of 5 cm). These values are insufficient for optimum impact processes such as are necessary for matrix printers, for example.

The simplest way of increasing the stroke is to use long piezo crystal elements, but the disadvantages of this would be unhandiness, high price, high capacity, and ever increasing oscillation periods of the system. Even if these disadvantages may be tolerated in the interest of a larger elongation, the impact velocities would remain unaffected, i.e., they cannot be increased by such measures.

From the German Offenlegungsschrift No. 2 342 021, a matrix print head for typewriters is known, wherein different electric fields are applied in rapid succession to elongated piezoelectric transducers which act on dot-generating, adjacent print elements. The structure described in said Offenlegungsschrift does not permit a sufficient elongation (for multiple forms, i.e., copies) of the piezo crystal. In the case of an optimum adaptation of the mass, the mass of the printing needle would have to correspond to the effective mass of the piezo crystal, i.e., the mass of the needle would have to be very large. This, in turn, would have the disadvantage that high printing frequencies would be impossible, because the crystal elongation velocity is below 0.1 m/sec—assuming adequate crystal lengths.

Moreover, it has been proposed to provide a matrix printer with piezoelectrically operated printing needles with a buckling spring which is deflectable in the case of an electrically controlled elongation of a piezo-crystal structure, the deflection of the buckling spring being transferrable to a printing needle coupled to it.

This structure has the disadvantage that a buckling spring is soft and permits only low printing forces and limited printing frequencies. In addition, the buckling process subjects the material to substantial stresses.

OBJECTS OF THE INVENTION

In light of the foregoing problems in the prior art, it is the object of this invention to provide an improved drive system which, while using the usual piezo crystal structures, permits increasing the impact velocity and/or a controlled stroke.

BRIEF DESCRIPTION OF THE DRAWINGS

Practical examples of the preferred embodiments of the invention are shown in the drawings and will be described in greater detail below.

DETAILED SPECIFICATION

Figure 1:
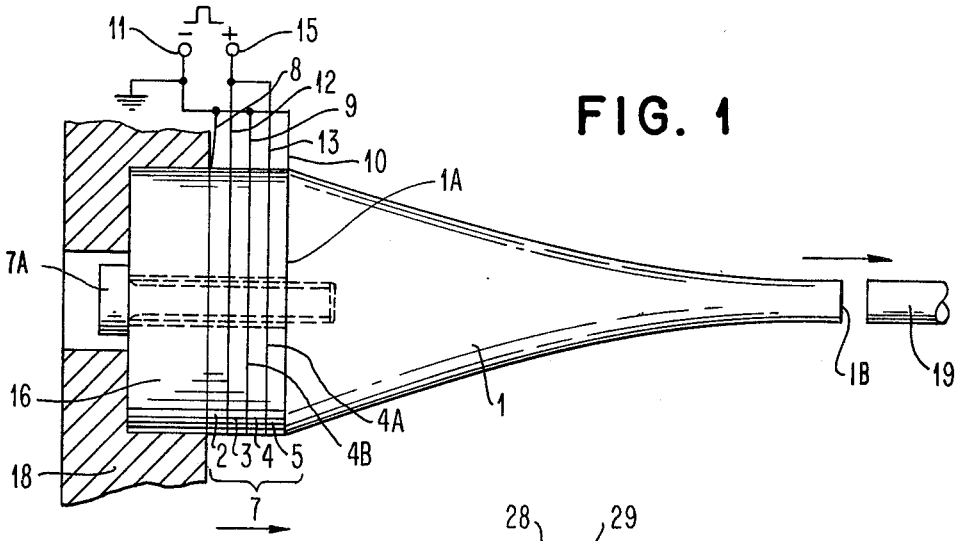
FIG. 1 is a diagrammatic representation of a piezoelectrically driven horn for driving the printing needle of a matrix printer.

FIG. 1 shows a piezoelectrically driven horn for driving the printing needle of a matrix printer. The horn is referred to as 1. Horn 1 is preferably tapered towards the tip, following an exponential course. Deviations from this course affect the pulse transfer function. The horn preferably consists of solid material of the kind generally used in ultrasonic technology, preferably aluminum and at best titanium alloys. On the base surface 1A of the horn 1, a bundle 7 of piezoelectric crystal elements 2, 3, 4, and 5 is arranged which by means of a clamping stud 7A and a clamping plate 16 which are rigidly connected to the horn 1. The piezo crystal structure 7 is energized by electric pulses. The pulses are applied to the terminals 11 and 15, lines of which lead up to the individual pole connecting faces of the piezoelectric crystal elements.

Upon energization, the piezo crystal structure 7 is subject to deformation which, via the base surface 1A of the horn 1, propagates into the horn 1. As a result of the generally known horn transfer properties, the elongation of the piezo crystal structure 7 is transformed into an increase in stroke and velocity on the horn tip 1B. This means that smaller elongations of the piezo crystal structure 7 affect the horn tip to create larger strokes. Also, compared to the elongation velocity of the piezo crystal structure, the velocity of the horn tip is higher.

The horn tip is freely movable in a longitudinal direction. The base or clamping plate 16, serving to fix the piezo crystal structure 7 to the horn base surface 1A, is permanently connected to the supporting part 18 either by means of a screw joint, a welded or an adhesive joint, or by some other means. Upon application of a pulse, the horn tip 1B is elongated in the direction of the arrow, acting by impact coupling on the printing needle 19 which is thus accelerated in the direction of print. As the mass of the printing needle is very small in comparison to the effective mass of the horn tip which is substantially greater, the impact additionally leads to an increase in velocity in accordance with the momentum conservation law.

The printing needle is guided in a known manner (e.g., in printers such as the IBM 3284 or 3286) in a flexibly suspended guide. This guide does not form part of the subject matter of the invention and is, therefore, not shown or described in detail. Further means for coupling the horn tip to the printing needle would be, for example, a fixed coupling obtained by soldering, welding, etc.

The individual piezo crystal elements 2 to 5 are commercially available. Such a piezo crystal element is provided with two pole connecting faces, e.g., 4A and 4B. Upon application of a corresponding control voltage to the pole connecting faces, the length of the element is changed. The individual piezo crystal elements 2 to 5 are connected in such a manner that similar pole connecting faces are arranged adjacent to each other. They are thus electrically paralleled and mechanically series-connected with regard to their effective elongation. The complete piezo crystal structure 7 should always comprise an even number of piezo crystal elements. All pole connecting faces associated with a negative polarization polarity are connected to the positive pole + of a voltage source via the lines 12 and 13. All pole connecting faces of a positive polarization polarity are connected to the negative pole − of said voltage source via the lines 8, 9, and 10. If the piezo crystal structure 7 consists of an even number of piezo crystal elements, the terminals for the positive pole + of the voltage source, which are arranged inside said structure, are shielded in the case of external pole connecting faces with a positive polarization polarity, which are connected to the negative grounded pole − of the voltage source.

Upon application of a control pulse to terminals 11 and 15, the effective elongations of the individual piezo crystal elements 2 to 5 cumulate in the arrow-marked direction. This cumulative elongation is transferred to the horn 1 and is transformed, as described above, in the direction of the horn tip 1B.

It is pointed out that it is also possible to use piezo crystal elements in which the polarization direction and the electric field are perpendicular to each other. In such a structure the piezo crystal element in the direction of polarization is subject to smaller length changes than in cases where the direction of polarization corresponds to the direction of the electric field.

It is conducive to the operation of the structure in accordance with the invention that disk-shaped piezo crystal elements be used and stacked upon each other. Such elements should be tapered in the direction of the horn tip and thus are adapted to the transfer characteristic of the horn. The length of the piezo crystal structure 7 governs the lengths of the edges of the pulses emitted on the horn tip and thus also the time available for the impact. A length of 5 cm corresponds to a typical order of magnitude. The total length of the piezo stack 7 is derived from the relation that the transit time in the piezo crystal structure should exceed the impact time by L/c (where L=length of the piezo stack and c=speed of sound in the material of the horn.

The horn length L is to be chosen in such a manner that the elongation (stroke) on the horn tip is high in relation to the elastic deformations of horn tip and printing needle upon impact and high in relation to the peak-to-valley heights of the impact faces concerned.

The physical-mathematical principles of amplitude and velocity transformation on horns are known, for example, from E. Eisner "Journal of the Acoustical Society of America," Volume 41, page 1126 (1967).

In accordance with this, the velocity amplitude on the horn tip is essentially a function of the horn parameter resulting from the input face/output face ratio (input face=base surface 1A; output face=face 1B of the horn tip). With an exponentially tapered horn having an input face/output face ratio of 1 $cm^2$/1 $mm^2$, the velocity on the horn tip increases by the factor 5 to 6.

As previously mentioned, the printing needle is driven by impact coupling as a result of the horn tip bouncing forward. The printing needle, as described above, is flexibly guided in a conventional manner, to accelerate the restoring motion and to ensure permanent contact of the faces in between impacts. The surfaces of both impact elements, horn tip and printing needle, should have Vickers hardnesses exceeding 600 kp/$mm^2$, to prevent permanent deformations.

Figure 2:
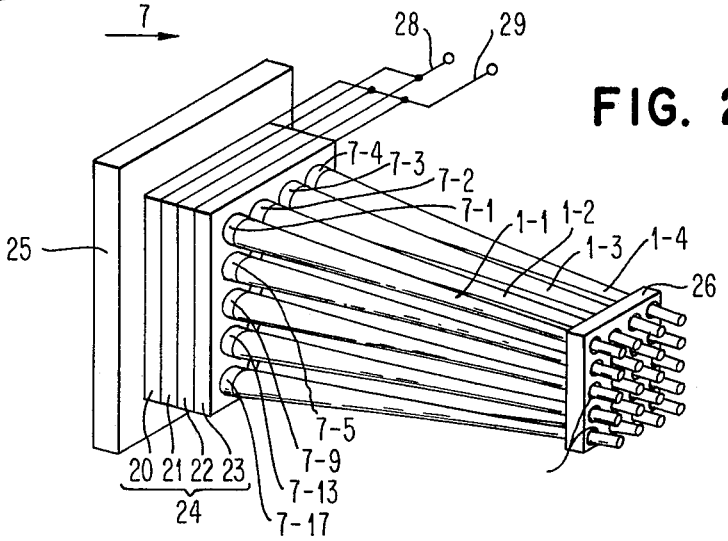
FIG. 2 is a diagrammatic perspective view of a matrix-type arrangement of several horns.

In conventional matrix printers, a character to be printed is generated by several print wires. Said print wires can be arranged either one below the other in a column or in matrix form. To realize, for example, a matrix-type printer arrangement with several printing needles, the individual horns 1 associated with each print wire each must also be arranged in matrix form, as shown in FIG. 2. Each horn 1-1, 1-2, 1-3, 1-4 to 1-20 carries its own piezo crystal structure 7-1, 7-2, 7-3 to 7-20 on its base surface. The totality of the horns with associated piezo crystal structure is arranged in matrix form on a common piezo crystal structure 24. This piezo crystal structure 24, analogous to the piezo crystal structure 7 of each horn 1, consists of several piezo crystal elements 20 to 23 which are similarly connected and which by means of a pulse on terminals 28 and 29 are induced to a basic deformation. This basic deformation is selectively superimposed by the elongation of the piezo crystal structure 7-1 to 7-20 of each horn 1-1 to 1-20, provided the structure is induced to a deformation by means of an electric pulse. For simplicity's sake, the electrical connections for the individual piezo crystal structures 7-1 to 7-20 are not shown.

In this manner a maximum stroke made up of the deformation of the piezo crystal structure of the horn proper and that of the common piezo crystal structure 24 is obtained on the tip of a selected horn. The common piezo crystal structure 24, in turn, is mounted on a rigidly fixed base plate 25. The individual horns are held by bolts (not shown) which from the rear side of the base plate 25 extend through bores in the individual piezo crystal elements of the stack 24 and through bores in the individual elements of the piezo crystal structures 7-1 to 7-20 specific to each horn. For geometric reasons, the totality of the horn tips must be merged on a surface which is smaller than the surface of the common piezo crystal structure 24. This surface transformation is necessary because the arrangement of the horn tips must be adapted to the matrix of the print wires (not shown). To force such a surface transformaton (for the center line of the individual horns, a path deviating from a straight line is necessary), the individual horn tips are led through the guide holes 27 of a horn tip guide element 26, which are arranged in matrix form. From guide element 26 said horn tips act on their associated printing needles (not shown) by impact coupling, for example.

For a perfect print, final velocities on the horn tip of 5 m/sec. are necessary. The stroke associated with this velocity must be of the order of about 20 $\mu$m, which is sufficient for the impact process. The stroke obtained must considerably exceed the elastic deformations which are encountered upon impact both on the horn tip and on the printing needle. In the case of a horn with a stroke and velocity transforming function, the piezo crystal elements are subjected to less mechanical wear than if they had to provide the required stroke themselves. As a result, the risk of mechanical depolarization of the piezo crystal elements is eliminated.

Print processes require clearly controlled stroke and velocity characteristics of the horn tip. At high printing frequencies, the horn tip must be available for a new printing step without ensuing free oscillations. To achieve this, the individual horns are energized by means of a control pulse and a control pulse program, respectively, which are applied to the piezo crystal structure.

Figure 3A:
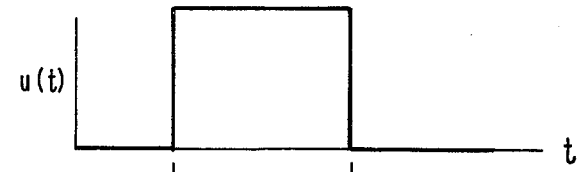
FIG. 3A is a diagrammatic representation of a control pulse with the amplitude represented as a function of time.
Figure 3B:
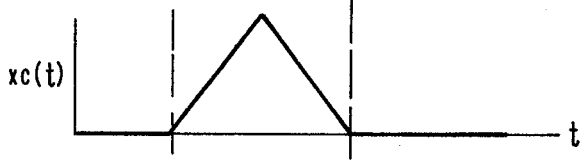
FIG. 3B is a diagrammatic representation of the elongation of the piezo crystal structure as a function of time in the case of energization in accordance with FIG. 3A.
Figure 3C:
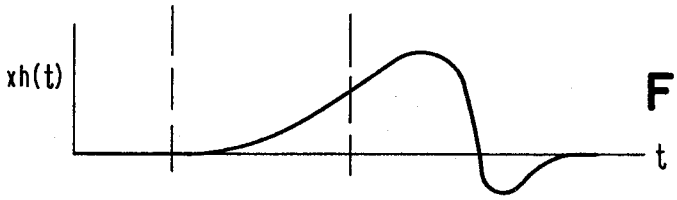
FIG. 3C is a diagrammatic representation of the elongation of the horn tip as a function of time in the case of energization in accordance with FIG. 3A.

FIG. 3A shows such a control pulse with the amplitude being a function of time. (Time=t, amplitude=u). In time relation to this representation, FIG. 3B shows the elongation xc of the piezo crystal as a function of the time t, and FIG. 3C shows the elongation of the horn tip xh as a function of the time t. The triangular stroke path in accordance with FIG. 3B may be theoretically explained by means of the article by W. Eisenmenger in the German journal "Acustica" 9, page 327, 1959.

Upon application of a pulse to the whole piezo crystal structure 7, the latter is mechanically biased. As a result of this bias, so-called strain waves from the ends of the piezo crystal structure 7 extend linearly into the crystal, leading to areas of increasing linear deformation in the direction of the crystal center.

In comparison to the elongation of the piezo crystal structure in accordance with FIG. 3B, the elongation of the horn tip is partly negative and delayed in time as a result of the dispersion of the wave in the horn proper. The path of elongation of the horn tip in accordance with FIG. 3C is an optimum one which can be obtained only if the pulse width of FIG. 3A has a particular value. If the pulse width exceeds or is less than this value, periodic elongations, whose amplitudes decrease merely as a result of damping in the piezo crystal structure and in the horn proper, rather than single elongations are encountered. Such periodic free oscillations are undesirable, because they do not permit high printing frequencies. A high printing frequency necessitates that the horn tip is at rest before a new print process is started.

Figure 4A:
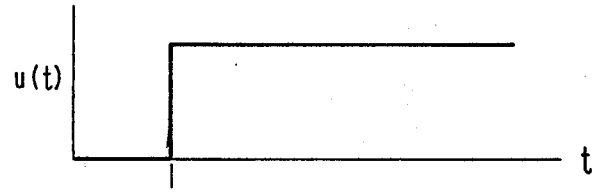
FIG. 4A is a diagrammatic representation of the energization of the piezo crystal structure by means of a voltage step with the amplitude as a function of time.

Ensuing free oscillations of this kind are also encountered when the piezo crystal structure is merely energized as a result of a voltage step in accordance with FIG. 4A.

Figure 4B:
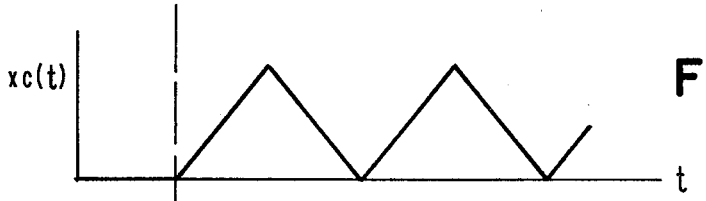
FIG. 4B is a diagrammatic representation of the elongation of the piezo crystal structure as a function of time in the case of energization in accordance with FIG. 4A.
Figure 4C:
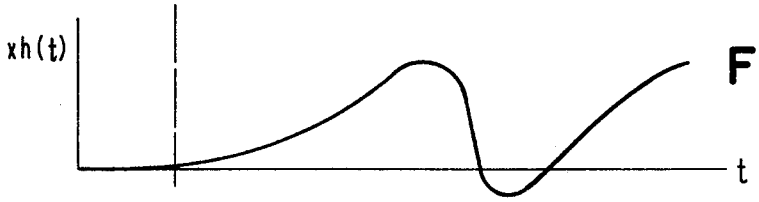
FIG. 4C is a diagrammatic representation of the elongation of the horn tip as a function of time in the case of energization in accordance with FIG. 4A.

In FIG. 4A the course of the voltage step is shown as a function of time (time=t; amplitude=u). In time relation to this representation, FIG. 4B shows the elongation of the piezo crystal structure xc as a function of the time t, and FIG. 4C shows the elongation xh of the horn tip as a function of the time t.

In the case of such step-shaped energization in accordance with FIG. 4A, the expansion in the crystal shows a permanent periodicity. In practice, the amplitudes occurring would assume lower values as a result of damping in the course of time. The path of elongation on the horn tip in accordance with FIG. 4C is also subject to ensuing free oscillations which are merely influenced by damping. It is pointed out that in this case a periodicity in the amplitude course is not given because of the transfer conditions in the horn.

In the ideal case (piezo crystal structure without attached horn), this favorable pulse width in accordance with FIG. 3A has a value of $$\frac{4 \times \text{crystal length}}{\text{speed of sound in the material of the horn}}$$

This favorable pulse width is desirable because it leads to clear elongation characteristics on the horn tip without detrimental echo or reflection effects.

If the horn tip is to be elongatable by x within the shortest time and subsequently is to be at a complete standstill (without ensuing free oscillations), a control pulse program in accordance with FIG. 5 should be chosen for the piezo crystal structure (time=t; amplitude=u). This representation shows a so-called double step in the control pulse, whereby the step size is to have a magnitude of 2(L/c) (L=length of the piezo crystal structure; c=speed of sound in the horn material). This applies to an ideal piezo crystal body without a horn coupled to it. Such control of the piezo crystal structure can be applied to particular advantage in so-called servo systems which are intended to perform accurately controlled strokes in the minimum time.

For matrix printing, on the other hand, the horn tip must have an initial velocity which is as high as possible over an adequate length of stroke. In such a case it is advisable to control the piezo crystal structure by means of pulses in accordance with FIG. 6A (time=t; amplitude=u). In time relation to this representation, FIG. 6B shows the elongation of the piezo crystal structure xc as a function of the time t, and FIG. 6C shows the elongation xh of the horn tip as a function of the time t. With such a course of the control variable (FIG. 6A) optimum velocity relations are obtained on the horn tip (FIG. 6C). The voltage course for controlling the piezo crystal structure is characterized in that a negative pulse of the width 2(L/c) is followed by a positive pulse of the width 4(L/c) and then again by a negative pulse of the width 2(L/c). (L=length of piezo crystal structure; c=speed of sound).

The elongation velocity of the piezo crystal structure corresponds to the pitch of the edges in accordance with FIG. 6B. This representation thus shows that during the first negative pulse having a width of 2(L/c) the piezo crystal structure contracts at a relatively low velocity during the positive pulse with the width 4(L/c). Subsequently, during the second negative pulse with a width of 2(L/c), the piezo crystal structure again contracts at simple velocity. FIG. 6C shows the elongation of the horn tip as a function of time, which means that the horn tip initially moves back at a low velocity, to subsequently expand at about three times that velocity in the direction of print. Then the horn tip returns to its standstill position at low velocity, performing a short stroke. Use of the voltage course in accordance with FIG. 6A for the control of the piezo crystal structure ensures that the printing needle dynamically returns to its standstill position shortly before the pulse program is terminated.

A further advantage of a pulse-controlled horn is the high concentration of kinetic energy in the region of the horn tip, which increases the effectiveness of the energy transfer.

For impact operation (horn/printing needle) the pulse program can be modified to compensate the effect of the printing needle bouncing back. By means of a correspondingly predetermined control pulse at the time when the needle bouncing back impacts the horn tip, a velocity opposed to that of the needle can be generated in the horn in such a manner that the two velocity components cancel each other. The use of such a compensating pulse ensures that after impact needle and horn tip are dynamically at rest. Such a compensating pulse can be empirically determined as a function of the mass and velocity of bodies impacting each other.

The difference between the representation of the elongation of an unloaded piezo crystal structure in comparison to the deflection on the horn tip (see FIGS. 4A-3C, 4A-4C, 6A-6C) is due to the fact that the impact waves in the horn, in addition to delays in the travel times and reflections, are subject to distortions.

Figure 5:
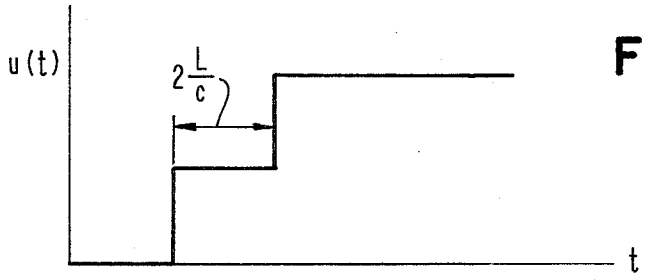
FIG. 5 is a diagrammatic representation of a step-shaped voltage course for energizing the piezo crystal structure to avoid resonance phenomena.
Figure 6A:
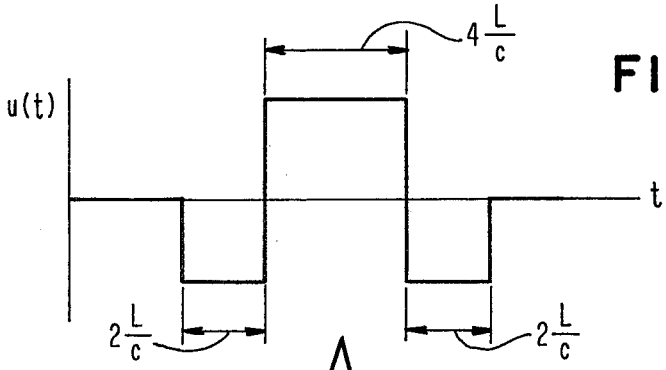
FIG. 6A is a diagrammatic representation of the voltage course for energizing the piezo crystal structure to obtain optimum velocity relations on the horn tip.
Figure 6B:
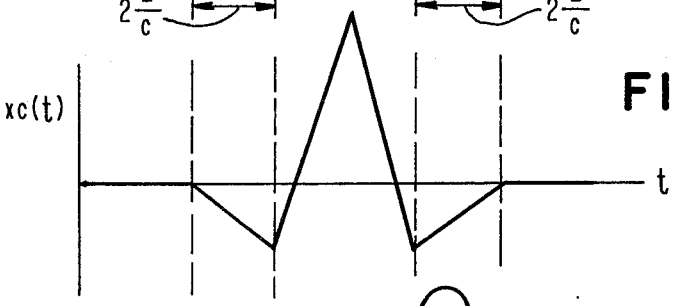
FIG. 6B is a diagrammatic representation of the elongation of the piezo crystal structure as a function of time in the case of energization in accordance with FIG. 6A.
Figure 6C:
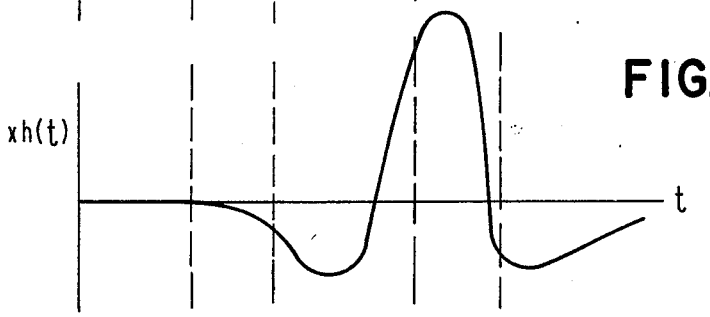
FIG. 6C is a diagrammatic representation of the elongation of the horn tip as a function of time in accordance with an energization of FIG. 6A.

The pulse widths shown in FIGS. 3A, 5, 6A are to be adapted to such distortions, empirically determining that pulse width at which the horn tip at the end of the pulse does not continue to oscillate.

Even though the example of FIGS. 1 and 2 refers to a matrix printer, the system in accordance with the invention can also be used elsewhere.

Figure 7:
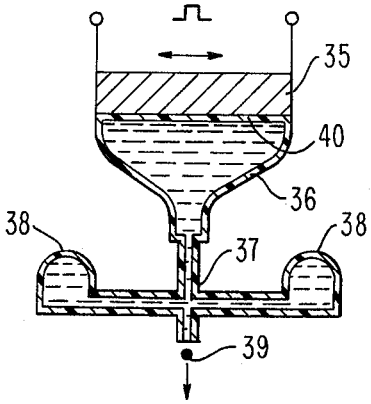
FIG. 7 is a diagrammatic representation of an arrangement for generating ink droplets in ink jet printers.

The structure in accordance with the invention is also suitable for ink jet printers. In accordance with a known principle ("IBM Journal of Research and Development," 1977, page 2) an electric control pulse, as shown in FIG. 7, is applied to a piezo crystal element 35. As a result of this pulse, the piezo crystal element is deformed in the arrow-marked direction. The deformation is transferred to a fluid reservoir 36 connected to the piezo crystal element, so that from a cannula system, with storage tank 38 connected to said reservoir, an ink droplet 36 is emitted at the exit opening. The fluid reservoir is separated from the piezo crystal 35 by means of a membrane 40. The energy of a tiny droplet thus emitted is of the order of 5 erg and thus considerably below the energy which is generally required for matrix printing.

Figure 8:
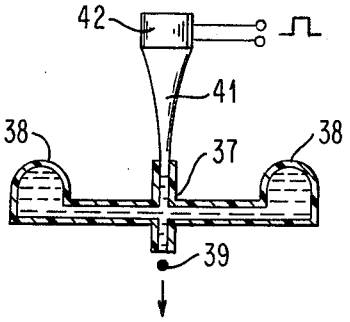
FIG. 8 is a diagrammatic representation if an arrangement for generating ink droplets in ink jet printers using the piezoelectrically driven horn in accordance with the invention.

In FIG. 8 the cannula system is again designated as 37 and the connected storage tank as 38. The tip of the piezoelectrically controlled horn 41 in accordance with the invention, on whose base surface the piezo crystal structure 42 energized by a pulse (a pulse program) is arranged, leads into said cannual system.

The pulse control permits a more direct control of the pressure conditions in the cannula system than would be possible in the arrangement of FIG. 7. The usual reservations with regard to a damped retraction of the membrane (FIG. 7) do not apply in this case. The use of the prior art reservoir with the membrane does not permit higher frequencies during the generation of ink droplets. Higher frequencies are necessary, however, to ensure a higher printing efficiency and a better quality of print which can be obtained by means of the system in accordance with the invention.

Having thus described by invention, what I claim as new, and desire to secure by Letters Patent is:

1. Piezoelectrically operated drive apparatus for matrix printer elements, comprising:

a tapered, horn shaped body of material having a base surface input end and a surface output end located at opposite ends of said horn shaped body;

a piezoelectric crystal structure energizable by electric current attached to said base surface input end of said horn shaped body; and means for applying controlled electrical pulses being of rectangular form and of controlled duration and applied in a plurality of steps in which the voltage level of said steps increases in amplitude to generate a controlled stroke response at the output end of said horn body.

2. A method of operating a piezoelectrically controlled drive system for matrix printers having a horn shaped transmission body having a base input surface on one end of said horn shaped body and an output surface on the other end thereof and a peizoelectric crystal structure attached to said base input surface end of said horn, comprising steps of:

energizing said piezoelectric crystal means by means of an electrical pulse of rectangular form and of controlled duration, said energizing being conducted in a plurality of steps during said pulse, the voltage level level of said steps increasing in amplitude to generate a controlled stroke response at the output surface of said horn body.

3. The method as described in claim 2, further comprising:

applying a sequence of negative, positive and negative rectangular shaped pulses of controlled duration to said piezoelectric crystal for generating a high impact velocity at said horn shaped body output surface.

* * * * *